US009989248B2

(12) United States Patent
Angulo et al.

(10) Patent No.: US 9,989,248 B2
(45) Date of Patent: Jun. 5, 2018

(54) PREMIXED STAMPED INNER FLAMES BURNER WITH ECCENTRIC INJECTION VENTURI

(71) Applicant: Whirlpool Corporation, Benton Harbor, MI (US)

(72) Inventors: Jorge Richard Angulo, Guanajuato (MX); Jonathan Tovar Balderas, Guanajuato (MX); Victor Ruelas Fajardo, Guanajuato (MX); Victor Gerardo Caloca Galindo, Celaya (MX); Francisco Javier Soria, Celaya (MX)

(73) Assignee: Whirlpool Corporation, Benton Harbor, MI (US)

( * ) Notice: Subject to any disclaimer, the term of this patent is extended or adjusted under 35 U.S.C. 154(b) by 436 days.

(21) Appl. No.: 14/847,280

(22) Filed: Sep. 8, 2015

(65) Prior Publication Data

US 2017/0067632 A1 Mar. 9, 2017

(51) Int. Cl.

| | |
|---|---|
| ***F23D 14/04*** | (2006.01) |
| ***F23D 14/06*** | (2006.01) |
| ***F23L 9/00*** | (2006.01) |

(52) U.S. Cl.

CPC ..... *F23D 14/06* (2013.01); *F23D 14/04* (2013.01); *F23L 9/00* (2013.01)

(58) Field of Classification Search

CPC ..... F23D 14/04; F23D 14/06; F23D 14/065
See application file for complete search history.

(56) References Cited

U.S. PATENT DOCUMENTS

| | | | | |
|---|---|---|---|---|
| 6,017,211 | A * | 1/2000 | Gort | F24C 3/085 126/39 E |
| 7,101,174 | B2 | 9/2006 | Tomiura et al. | |
| 7,291,009 | B2 | 11/2007 | Kamal et al. | |
| 8,206,148 | B2 * | 6/2012 | Paesani | F23D 14/065 126/39 E |
| 8,220,450 | B2 | 7/2012 | Luo et al. | |
| 8,616,193 | B2 | 12/2013 | Padgett | |
| 2003/0190573 | A1 | 10/2003 | Keem | |
| 2011/0086318 | A1 * | 4/2011 | Schwierking | F23D 14/06 431/8 |
| 2014/0090636 | A1 * | 4/2014 | Bettinzoli | F23D 14/06 126/39 E |
| 2015/0040887 | A1 | 2/2015 | Angulo | |

* cited by examiner

*Primary Examiner* — David J Laux
(74) *Attorney, Agent, or Firm* — Price Heneveld LLP

(57) ABSTRACT

A burner assembly for a cooktop includes a base portion having one or more vents and an eccentric stem. A cover portion is received on the base portion to define a mixing chamber disposed between the cover portion and the base portion. The cover portion includes a plurality of fuel ports opening inwardly into a centrally disposed combustion chamber. A venturi mixer is received through the eccentric stem and is configured to provide a primary-air and gas mixture to the mixing chamber as supplied from the cooktop. An aperture is disposed through an upper surface of the cooktop and is configured to pivotally receive the eccentric stem of the base portion for pivoting the burner assembly on the cooktop.

15 Claims, 3 Drawing Sheets

PREMIXED STAMPED INNER FLAMES BURNER WITH ECCENTRIC INJECTION VENTURI

BACKGROUND

Existing burners in the market configured to provide high efficiency solutions may include a triple ring or dual ring burner configuration that employs an external flame concept found in conventional burners. Other high efficiency solutions may use an internal flame concept, but are generally limited to a primary-air and gas mixture, as secondary air flow to the flames produced by the burner is often obstructed. Thus, a burner is desired that provides a high efficiency solution, wherein consistent velocity is achieved at all burner ports while providing unencumbered secondary air flow.

SUMMARY

One aspect of the present concept includes a burner assembly having a base portion which includes an upwardly opening channel. A cover portion is configured to be received on the base portion and includes a downwardly opening channel. The upwardly opening channel of the base portion is configured to align with the downwardly opening channel of the cover portion to define a circular mixing chamber. An eccentric stem extends downwardly from the base portion and opens into the mixing chamber. A venturi mixer is received through the eccentric stem and is configured to provide a primary-air and gas mixture to the mixing chamber from a supply source.

Another aspect of the present concept includes, a burner assembly for a cooktop, wherein the burner assembly includes a base portion having one or more vents and an eccentric stem. A cover portion is received on the base portion to define a mixing chamber disposed between the cover portion and the base portion. The cover portion includes a plurality of fuel ports opening inwardly into a centrally disposed combustion chamber. A venturi mixer is received through the eccentric stem and is configured to provide a primary-air and gas mixture to the mixing chamber as supplied from the cooktop. An aperture is disposed through an upper surface of the cooktop and is configured to pivotally receive the eccentric stem of the base portion for pivoting the burner assembly on the cooktop.

Yet another aspect of the present concept includes a burner assembly for a cooking device, wherein a ring-shaped mixing chamber is defined between a base portion and a cover portion. A centrally disposed and structure-free combustion chamber is disposed adjacent to the ring-shaped mixing chamber and a plurality of fuel ports are disposed on the mixing chamber and open inwardly into the combustion chamber. An eccentric venturi assembly is disposed through a stem disposed in the base portion. The stem extends downwardly from the base portion and is configured to be received in a mounting aperture disposed through an upper surface of the cooking device.

These and other features, advantages, and objects of the present device will be further understood and appreciated by those skilled in the art upon studying the following specification, claims, and appended drawings.

DETAILED DESCRIPTION OF EMBODIMENTS

Figure 1:
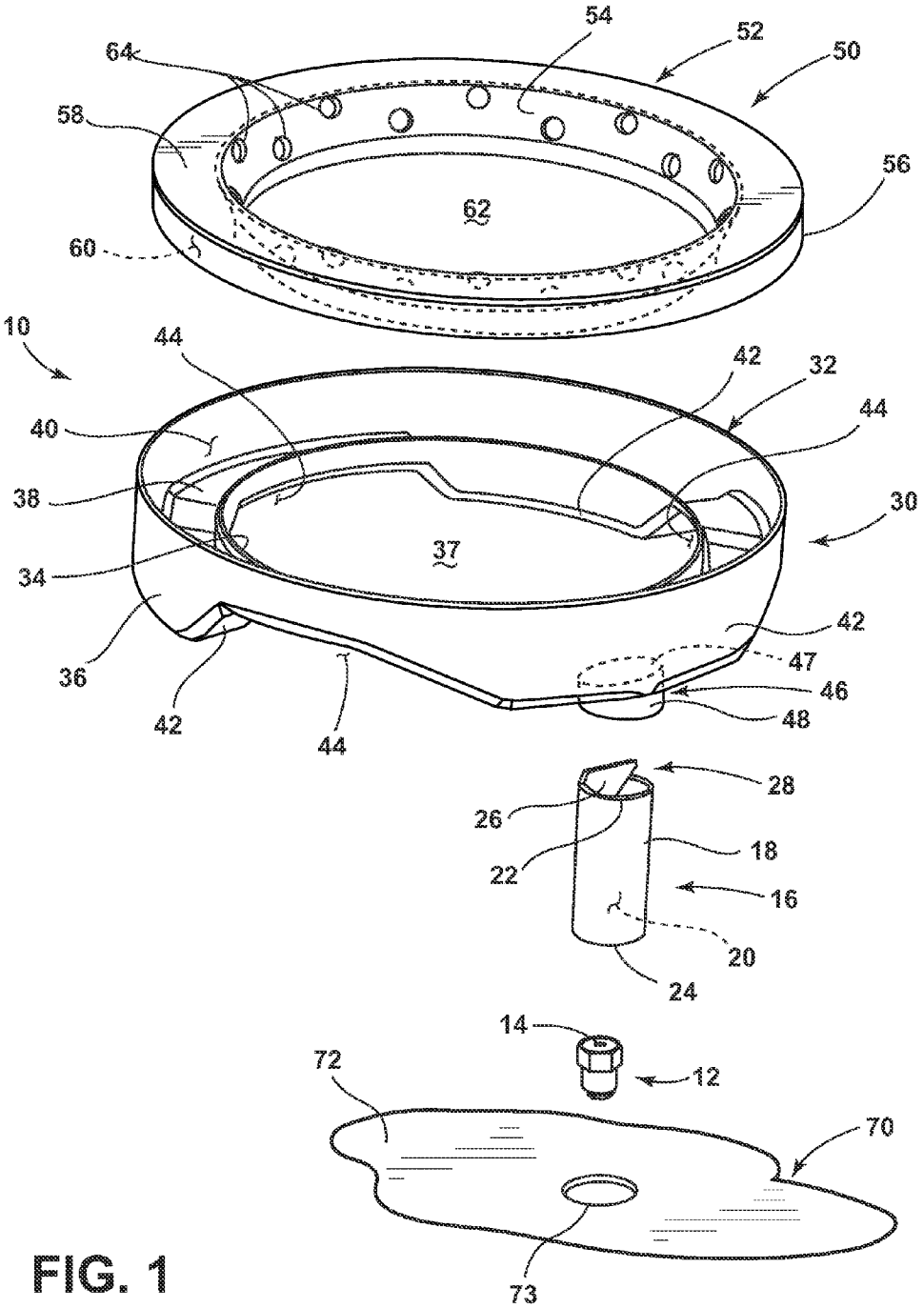
FIG. 1 is an exploded top perspective view of a burner assembly according to an embodiment of the present disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, a gas burner assembly 10 is shown having a gas injector 12 with a centrally disposed injector orifice 14 that is configured to supply gas to the burner assembly 10 as coupled to a gas supply line of a cooking device. A venturi mixer 16 includes a cylindrical body portion 18 defining a chamber 20 configured to receive, or otherwise be in fluid communication with, the gas injector 12. The mixing chamber 20 defines an air and gas mixing chamber having an upper outlet 22 and a lower inlet 24. The gas injector 12 is generally received at the lower inlet 24. The upper outlet 22 includes an angled portion 26 which narrows a diameter of the body portion 18 to define a venturi 28. The angled portion 26 further directs air and gas towards an outer portion of a mixing chamber 100 (FIG. 3), as further described below. As further shown in FIG. 1, a base portion 30 of the burner assembly 10 includes a generally circular or ring-shaped body portion 32 having inner and outer walls 34, 36 which are spaced-apart and interconnected by a bottom wall 38 disposed around a central aperture 37. Together, the inner and outer walls 34, 36 and bottom wall 38 cooperate to define a channel 40 disposed around the body portion 32 of the mixing chamber base 30. The channel 40, as shown in FIG. 1, is an upwardly opening channel configured to receive a gas and primary-air mixture as dispersed or injected from the venturi mixer 16. As further shown in FIG. 1, the bottom wall 38 of the mixer chamber base 30 includes standoff portions or feet 42 which are spaced-apart from one another to define secondary-air vents 44 therebetween. The standoff portions 42 provide a height relative to a support surface 72 necessary for secondary-air to freely flow through the secondary-air vents 44 as drawn towards a combustion chamber 102 (FIGS. 2, 3) from outside ambient air.

As further shown in FIG. 1, an eccentric stem 46 is disposed through the bottom wall 38 of the base portion 30, wherein the eccentric stem 46 is configured to receive the venturi mixer 16, or otherwise communicate with the venture mixer 16, for providing a gas and primary-air mixture to the channel 40 of the base portion 30. In this way, the base portion 30 provides for an eccentric venturi assembly 16 that is not centrally located with respect to the body portion 32 of the base portion 30, such that secondary-air flow is not impeded by the position of the venturi assembly, as further described below. Further, the eccentric location of the venturi assembly 16 provides for a combustion chamber 102 (FIGS. 2 and 3) that is completely free of structures, as further described below. As used herein, the term "eccentric" implies that the venturi assembly 16 is not placed centrally or does not have an axis or other part that is placed centrally with respect to the base portion 30. Thus, as shown in FIG. 1, the venturi assembly 16 aligns with and is received through a lower portion 48 of the stem 46 and extends through an opening 47 of the stem 46 disposed in the bottom wall 38 of the base portion 30. The eccentric stem 46 extends downwardly from the bottom wall 38 of the base portion 30 and is configured to be received in a mounting aperture 73 disposed on an upper surface 72 of a cooking appliance 70 for pivoting movement of the burner assembly 10, as further described below.

Figure 3:
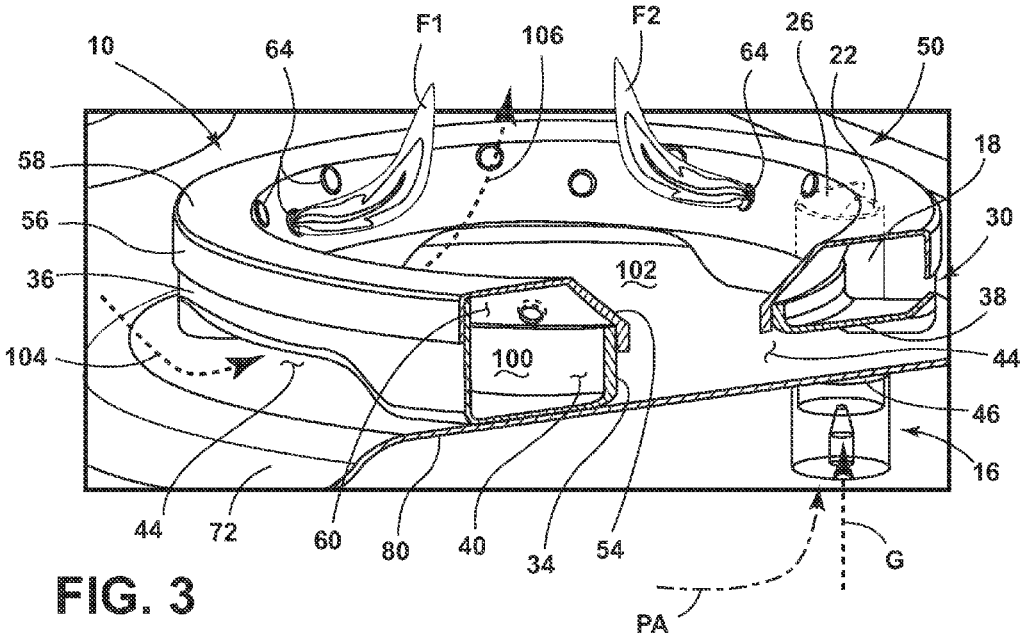
FIG. 3 is a fragmentary cross-sectional perspective view of the burner assembly and cooking device shown in FIG. 2.

As further shown in FIG. 1, the burner assembly 10 also includes a cover portion 50 having a generally circular or ring-shaped body portion 52 as defined by inner and outer walls 54, 56. The inner and outer walls 54, 56 are spaced-apart from one another and interconnected by a top wall 58 to define a downwardly opening channel 60. In assembly, the cover portion 50 is configured to be received on the base portion 30, such that the downwardly opening channel 60 and upwardly opening channel 40 cooperate to define a circular or ring-shaped mixing chamber 100, as best indicated in FIG. 3. The cover portion 50 includes a centrally disposed aperture 62 defined by inner wall 54. The centrally disposed aperture 62 is configured to align with centrally disposed aperture 37 of the base portion 30 when the cover portion 50 is received on the base portion 30 to define the parameters of the combustion chamber 102. As further shown in FIG. 1, the inner wall 54 of the cover portion 50 includes a set of variably-sized fuel ports 64 disposed therethrough which open upwardly and inwardly into the centrally disposed aperture 62. In use, the variably-sized fuel ports 64 are configured to direct flames towards the centrally disposed aperture 62 in an upward and inward direction, as further described below.

It is contemplated that the base portion 30 and cover portion 50 are comprised of materials configured to withstand operating temperatures generally associated with a cooktop burner. Such materials may include cast iron, carbon steel, die cast aluminum or other suitable materials. The base portion 30 and cover portion 50 are contemplated to be stamped parts, such that the burner assembly 10 is generally comprised of a two-piece stamped assembly.

Figure 2:
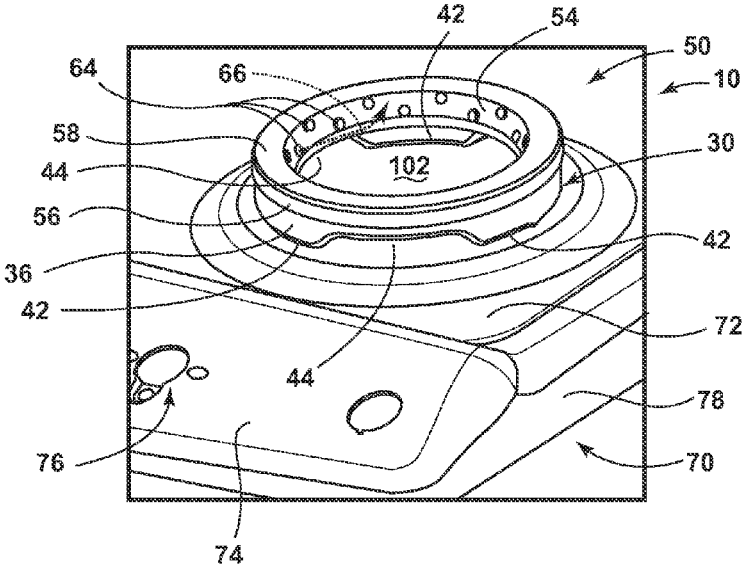
FIG. 2 is a top perspective view of the burner assembly of FIG. 1 as assembled and positioned on a cooking device.

Referring now to FIG. 2, the burner assembly 10 is shown in an assembled condition, wherein the cover portion 50 is disposed over or received on the base portion 30. The fuel ports 64 of the cover portion 50 are shown to direct the gas and primary-air mixture, and resulting flames, of the burner assembly 10 in an upward and inward direction as indicated by arrow 66. The standoff portions or feet 42 of the base portion 30 are shown in abutting contact with an upper surface 72 of a cooking device 70. The cooking device 70 shown in FIG. 2 is a cooktop appliance which includes a front panel 74 having a user interface 76 which is configured to set a desired temperature for the burner assembly 10, such that the cooktop 70 will internally provide for a desired gas flow and resulting flame intensity as provided by the cooktop 70 in a manner known in the art. Gas supply lines and other components of the cooktop 70 are contemplated to be disposed within a housing 78 of the cooktop 70, and are generally disposed below the upper surface 72 of the cooktop 70. With the standoff portions 42 of the base portion 30 abutingly supported on the upper surface 72 of the cooktop 70, the burner assembly 10 is raised off of the upper surface 72, such that the secondary air ports 44 are shown opening into a centrally disposed combustion chamber 102 into which the flames from the ports 64 are directed, as further described below. The combustion chamber 102 is a centrally disposed cylinder which defines a burner center and is generally defined by centrally disposed apertures 37, 62 of the base portion 30 and cover portion 56, respectively. The combustion chamber 102 is free from any obstacles or structures that could impede airflow to the combustion chamber 102. The cylindrical shape of the combustion chamber 102 is generally defined by the ring-shaped base portion and ring-shaped cover portion of the burner assembly. In this way, the combustion chamber 102 is a structure-free open circle providing for free flowing air and enhanced combustion.

Referring now to FIG. 3, a cross-section of the burner assembly 10 is shown, such that the ring-shaped mixing chamber 100, as formed by channels 40, 60 of the base portion 30 and cover portion 50, respectively, is shown as generally disposed around the combustion chamber 102. With the cross-sectional view of FIG. 3, the inner and outer walls 54, 56 of the cover portion 50 are shown disposed over the inner and outer walls 34, 36 of the base portion 30 to define the mixing chamber 100. The venture mixer 16 is shown opening into the mixing chamber 100 at upper outlet 22, through the eccentric stem 46. In this way, the primary-air and gas mixture from the venturi mixer 16 enters the mixing chamber 100 and is directed towards the outer walls 36, 56 of the base portion 30 and cover portion 50 by angled portion 26 of the venture mixer 16. Consistent velocity is achieved at each fuel port 64 due to a special port arrangement and variable port size that balance internal pressure of the mixing chamber 100 and promote as homogenous output velocity at the ports 64. As noted above, the angled portion 26 of the venturi mixer 16 deviates flow direction of the air and gas to the outer part of the ring defined by the mixing chamber 100. This directional flow, along with variable sized ports 64 placed at varying vertical positions along the inner wall 54 of the cover portion 50, helps to reduce a pressure gradient of the mixing chamber 100, thereby improving velocity output and further providing consistent velocity values at each port 64.

As shown in FIG. 3, arrow PA indicates primary-airflow to the venture mixer 16 and arrow G indicates gas supplied by the cooking device 70 to the venture mixer 16. A spark electrode (not shown) is configured to light the primary-air and gas mixture as the mixture enters the combustion chamber 102 to provide flames, such as flames F1, F2 shown exiting fuel ports 64 of the cover portion 50 in FIG. 3. The flames F1, F2 are exemplary flames only, and during operation of the burner assembly 10, it is contemplated that all fuel ports 64 will include flames directed inwardly and upwardly towards the combustion chamber 102 of the burner assembly 10. During the operation of the burner assembly 10, ambient air is pulled or drawn through the secondary-air vents 44 defined by the base portion 30 in a direction as indicated by arrow 104 from outside the burner assembly 10, towards the combustion chamber 102 as indicated by arrow 106. In this way, the secondary-air vents 44 are configured to provide unobstructed secondary-air flow to the combustion chamber 102 during a cooking procedure by convection currents cause by the combustion of the primary-air and gas mixture. The secondary-air flow helps to provide complete combustion of the primary-air and gas mixture, and otherwise promote consistent and even flames exiting fuel ports 64 in the combustion chamber 102.

The burner assembly 10 includes a gas flow path through eccentric stem 46, through the venturi mixer 16, to the mixing chamber 100, then through the fuel ports 64, and finally exiting into the combustion chamber 102. Gas is supplied to the burner 10 through the gas injector 12 of the cooking device 70. Primary-air PA and gas G (FIG. 3) is introduced into the venturi mixer 16 to form a combustible primary-air and gas mixture in the mixing chamber 100. The mixture is then expelled through the fuel ports 64 into the combustion chamber 102, where a spark electrode is used to ignite the primary-air and gas mixture. As noted above, the secondary-air vents 44 provide open and unobstructed paths from the outside ambient air to the open and structure-free circular combustion chamber 102 as indicated by arrows 104, 106 in FIG. 3. The draw of secondary-air into the combustion chamber 102 enhances the combustion characteristics of the burner assembly 10 by helping to ensure complete and efficient combustion.

Figure 4:
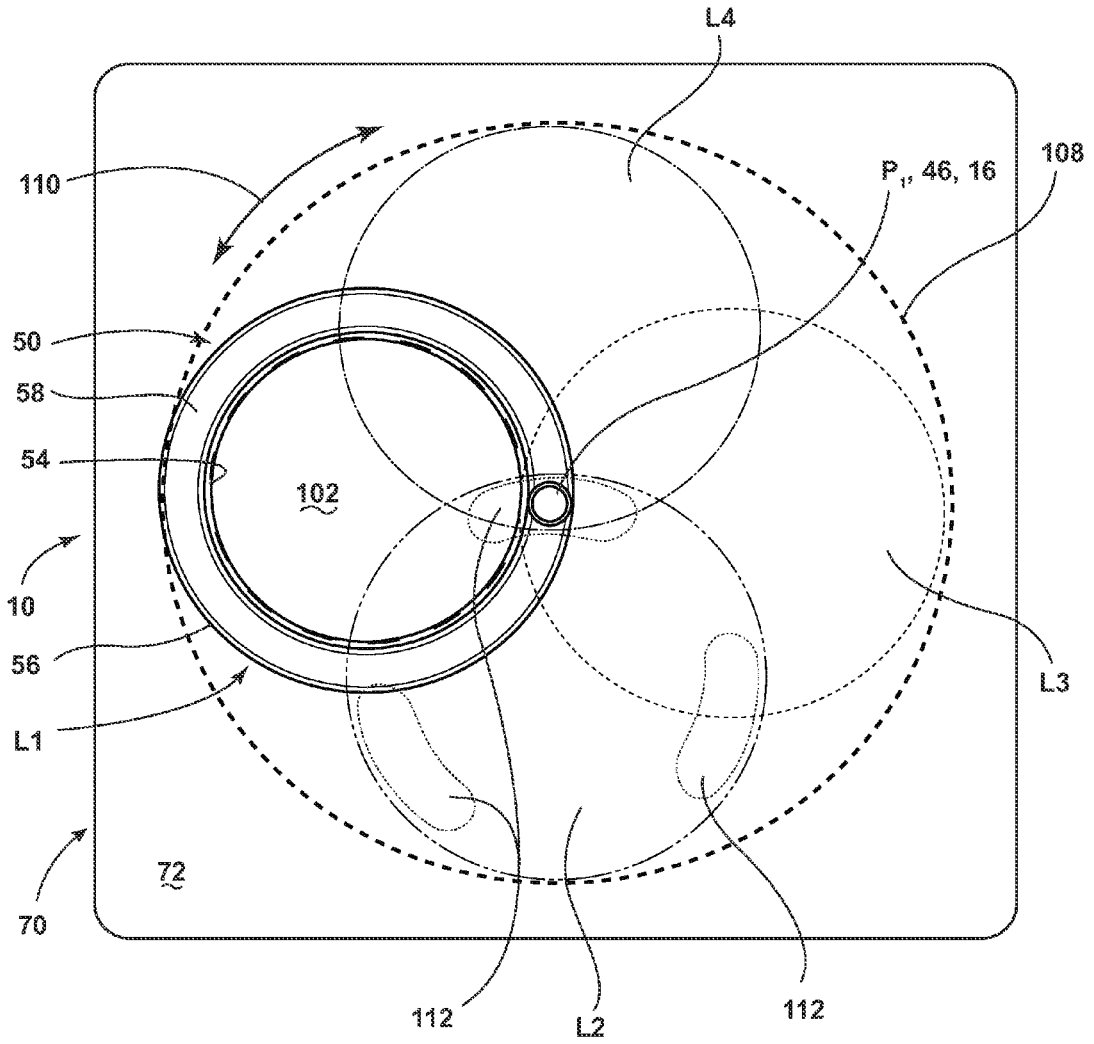
FIG. 4 is a top plan view of the assembled burner assembly of FIG. 2, showing relative movement of the burner assembly between various locations on a cooking surface of the cooking device.

Referring now to FIG. 4, the burner assembly 10 is shown disposed on an upper surface 72 of a cooking device 70, such as a cooktop. As noted above, the burner assembly 10 includes an eccentric venturi assembly 16 as received in eccentric port 46. The eccentric venturi assembly 16 provides for a connecting point with the cooking device 70 which can act as a pivot point P1 for rotation of the burner assembly 10. Thus, as shown in FIG. 4, the burner assembly 10 can assume various locations within an area 108 disposed on the upper surface 72 of the cooktop 70. In FIG. 4, four potential locations L1-L4 are shown, wherein the burner assembly 10 can be rotated to any such location to provide a cooktop configuration conducive to a user's needs. For example, on a crowded cooktop, it may be necessary to move the burner assembly 10 from location L1 to location L3 in a direction as indicated by arrow 110 in order to provide a cooking station that is distanced from an adjacent cooking station disposed near location L1. The locations of the burner assembly 10 can be preset locations, wherein inset locating features 112 are configured to receive the feet 42 of the base portion 30 of the burner assembly 10. Thus, the inset locating features 112 are contemplated to be detent features disposed on the upper surface 72 of the cooktop 70, and may be assigned to any number of preset locations, such as locations L1-L4. In moving the burner assembly 10 from one location to another, the user may simply pivot the burner assembly 10 at pivot point P1 in either direction as indicated by arrow 110. The burner assembly 10 may also accommodate lifting and pivoting the burner assembly 10 when inset locating features 112 are disposed on the upper surface 72 of the cooktop 70.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A burner assembly, comprising:

a base portion including an upwardly opening channel;

a cover portion received on the base portion having a downwardly opening channel, wherein the upwardly opening channel of the base portion is configured to align with the downwardly opening channel of the cover portion to define a circular mixing chamber;

an eccentric stem extending downwardly from the base portion and opening into the mixing chamber;

a venturi mixer received through the eccentric stem and configured to provide a primary-air and gas mixture to the mixing chamber from a supply source; a plurality of feet extending downwardly from the base portion for supporting the base portion above an upper surface of a cooking device; secondary-air vents disposed between the plurality of feet, wherein the secondary-air vents define a path from outside ambient air to the combustion chamber; and a plurality of insets disposed on the upper surface of the cooking device, wherein the insets are configured to receive the plurality of feet of the burner assembly as the burner assembly rotates between the plurality of burner locations disposed on the upper surface of the cooking device.

2. The burner assembly of claim 1, wherein supply source includes a cooking device.

3. The burner assembly of claim 2, wherein the eccentric stem is coupled to an upper surface of the cooking device at a lower portion of the eccentric stem.

4. The burner assembly of claim 3, wherein the burner assembly is configured to pivot at the coupling of the eccentric stem and the upper surface of the cooking device for rotation of the burner assembly between a plurality of burner locations disposed on the upper surface of the cooking device.

5. The burner assembly of claim 1, wherein the cover portion includes an inner wall having a set of fuel ports directed inwardly and upwardly into a centrally disposed combustion chamber.

6. The burner assembly of claim 5, wherein the combustion chamber is an open circular space defining a burner center.

7. The burner assembly of claim 1, wherein the cooking device includes a cooktop.

8. A burner assembly for a cooktop, comprising:

a base portion having one or more vents and an eccentric stem;

a cover portion received on the base portion to define a mixing chamber disposed therebetween, wherein the cover portion includes a plurality of fuel ports opening into a centrally disposed combustion chamber;

a venturi mixer received through the eccentric stem and configured to provide a primary-air and gas mixture to the mixing chamber from the cooktop; and an aperture disposed through an upper surface of the cooktop and configured to pivotally receive the eccentric stem of the base portion; a plurality of feet extending downwardly from the base portion for supporting the base portion above an upper surface of a cooking device; and a plurality of insets disposed on the upper surface of the cooking device, wherein the insets are configured to receive the plurality of feet of the burner assembly as the burner assembly rotates between the plurality of burner locations disposed on the upper surface of the cooking device.

9. The burner assembly of claim 8, wherein the vents define secondary-air vents disposed between the plurality of feet, wherein the secondary-air vents provide a path disposed under the base portion connecting outside ambient air to the combustion chamber.

10. The burner assembly of claim 9, wherein the fuel ports are configured to provide the primary-air and gas mixture to the combustion chamber from the mixing chamber at an upward and inward angle into the combustion chamber.

11. The burner assembly of claim 10, wherein the combustion chamber is an open circular space defined by ring-shaped body portions of the base portion and cover portion.

12. The burner assembly of claim 10, wherein the combustion chamber is a structure-free open space defining a burner center.

13. The burner assembly of claim 8, including:

a plurality of secondary-air vents disposed through the base portion, wherein the secondary-air vents provide a path disposed under the base portion connecting outside ambient air to the combustion chamber.

14. A burner assembly for a cooking device, comprising:

a ring-shaped mixing chamber defined between a base portion and a cover portion;

a centrally disposed and structure-free combustion chamber disposed adjacent to the ring-shaped mixing chamber, wherein a plurality of fuel ports disposed on the mixing chamber open inwardly into the combustion chamber; and an eccentric venturi assembly disposed through a stem disposed in the base portion, wherein the stem extends downwardly from the base portion and is configured to be received in a mounting aperture disposed through an upper surface of the cooking device; a plurality of feet extending downwardly from the base portion for supporting the base portion above an upper surface of a cooking device; and a plurality of insets disposed on the upper surface of the cooking device, wherein the insets are configured to receive the plurality of feet of the burner assembly as the burner assembly rotates between the plurality of burner locations disposed on the upper surface of the cooking device.

15. The burner assembly of claim 14, wherein the burner assembly is configured to pivot on the upper surface of the cooking device a coupling of the stem and the mounting aperture of the cooking device, such that the burner assembly can rotate between a plurality of burner locations disposed on the upper surface of the cooking device.

* * * * *